United States Patent [19]

Trybom

[11] 4,441,218

[45] Apr. 10, 1984

[54] POSITION ADJUSTING DEVICE FOR SANITARY AND PLUMBING UNITS USING WATER UNDER PRESSURE

[76] Inventor: Stig H. E. Trybom, Pampusvägen 59, S-60365 Norrköping, Sweden

[21] Appl. No.: 408,809

[22] Filed: Aug. 17, 1982

Related U.S. Application Data

[63] Continuation of Ser. No. 188,133, Sep. 17, 1980, abandoned.

[30] Foreign Application Priority Data

Sep. 18, 1979 [SE] Sweden ..... 7907709

[51] Int. Cl.[3] ..... E03D 11/00

[52] U.S. Cl. ..... 4/252 R; 4/420

[58] Field of Search ..... 4/191, 252 R, 564–566, 4/300, 420, 251, DIG. 2

[56] References Cited

U.S. PATENT DOCUMENTS

| | | | |
|---|---|---|---|
| 3,605,134 | 9/1971 | Haering | 4/252 |
| 3,914,806 | 10/1974 | Pearce | 4/564 |
| 3,925,833 | 12/1975 | Hunter | 4/251 |
| 4,091,473 | 5/1978 | Matthews et al. | 4/251 X |
| 4,174,546 | 11/1979 | Ohtake | 4/DIG. 2 |

*Primary Examiner*—Charles E. Phillips

*Attorney, Agent, or Firm*—Laff, Whitesel, Conte & Saret

[57] ABSTRACT

The invention relates to a position-adjusting device for sanitary and plumbing units using water under pressure, such as water closets, bidets, washbasins, showers, and the like. Position adjustments may be desirable in order to accommodate the needs of physically handicapped persons. Water, under pressure, is available at the sanitary unit in question. This water pressure is utilized to move the sanitary unit to positions which are uniquely accommodated to the particular user.

3 Claims, 3 Drawing Figures

POSITION ADJUSTING DEVICE FOR SANITARY AND PLUMBING UNITS USING WATER UNDER PRESSURE

This is a continuation of application Ser. No. 188,133 filed Sept. 17, 1980, now abandoned.

This invention relates to position-adjusting devices for sanitary and plumbing units which use water under pressure, such as water closets, bidets, washbasins, showers, and the like.

Very often, handicapped or motion-impeded people have difficulties in using conventional sanitary or plumbing units of the above-named and similar kinds. Some such units can be uncomfortable even to persons without any motion impediments. For intance, almost without exception, water closets are placed at a sitting height which is too low for many full-grown people. Washbasins are installed at a height location, which is supposed to fit some sort of an average person of a certain average height. However, it is uncomfortable for tall persons or for children. The mounting of bidets and showers may have the same or similar problems.

To manage this height problem, spacers of different thicknesses are sometimes used in order to selectively place the toilet seat of a water closet at a more accommodating sitting height for the person who, at each occasion, might use the toilet.

In hospitals or other nursing institutions, many persons who have suffered a handicap, or are in other ways are permanently or temporarily motion-impeded, may use sanitary units. Conventionally, it is very difficult to meet everyone's personal wants or needs as to the location of the unit, primarily its level above the floor.

Accordingly, an object of the present invention is to solve these and similar problems. Here, an object is to use water pressure as a motive force for moving sanitary or plumbing units.

A further object of the invention is to use the water pressure which is available at the sanitary unit to move that unit to a position selected by the user. This position may, for instance, be a variation in the height; or, it could be a variation of another usage position.

For other objects and for a better understanding of the invention, reference may be had to the following detailed description taken in conjunction with the accompanying drawings, in which.

Figure 1:
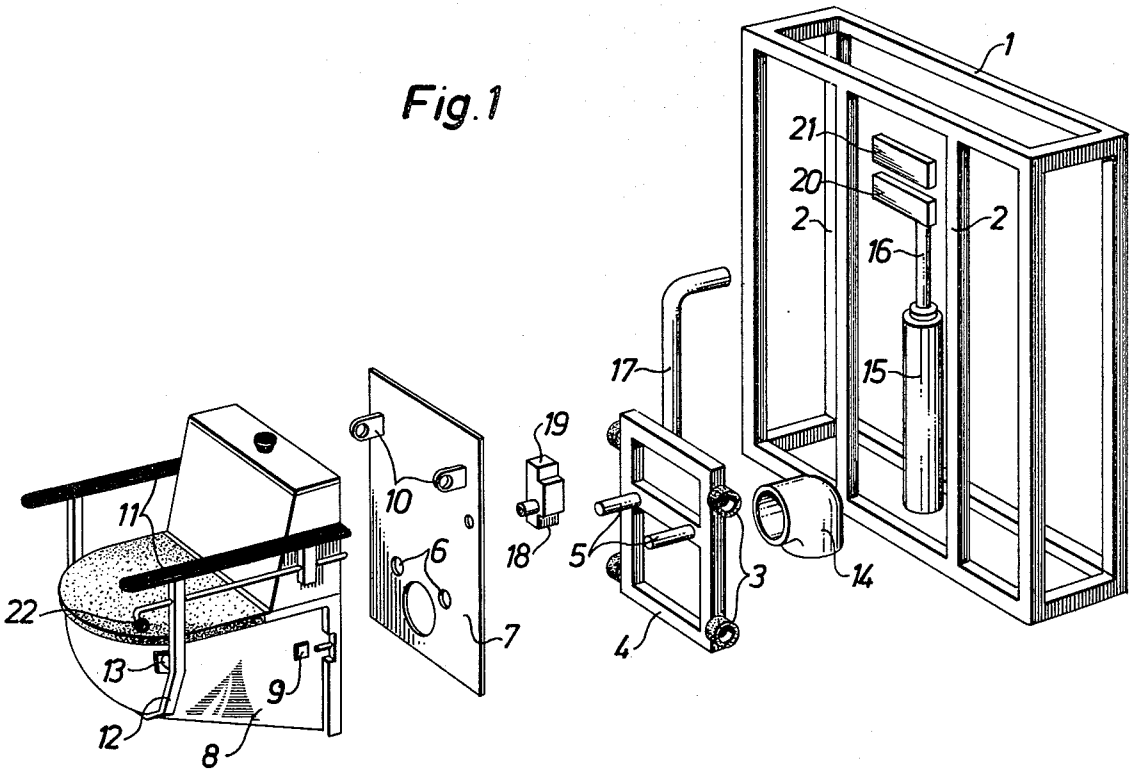
FIG. 1 is a perspective and partially exploded view of a device constructed according to the invention, as applied to a water closet.

An example of the invention is here given in connection with a water closet. The water closet shown in FIG. 1 is a type which hangs from the wall, as distinguished from standing on the floor. A framework 1 is placed behind the wall (not shown). This frame 1 has two vertically-extending U-shaped rails 2 with the openings of their U shapes turned toward each other. A trolley 4 (having four corner rollers) runs inside these U-shaped rails 2 with two of the four rollers 3 running inside each rail. Mounted on the trolley are two bolts 5, which pass through holes 6 in a covering plate 7 and through other and aligned holes which pass through the back of the water closet 8. These bolts 5 and their cooperating nuts 9 interconnect the trolley 4, the covering plate 7 and the water closet 8, with each other. The covering plate 7 also has opposing ears 10 for fastening the rear of armrests 11 to the water closet. The front ends of these armrests are connected to each other by way of a generally U-shaped bracket 12, which is located below the front part of the water closet. The bracket 12 is fastened to the sides of the water closet 8, just beneath the seat, by means of suitable cross bars 13.

For the drain, the water closet has a bent or angled tube 14 which is connected at its lower end to a flexible hose H1. That flexible hose is, in turn, connected to a commercial or city sewage disposal system.

A hydraulic cylinder 15 is fastened to the framework 1. The piston 16 of the cylinder 15 is connected to one end of a somewhat L-shaped arm member 17. The other arm of member 17 is fastened to the trolley 4. The hydraulic cylinder 15 is connected through hoses (not shown) via servo valves 18, 19 and via main valves 20, 21, which are connected to the commercial or city water mains. The main valves 20, 21 are controlled by the servo valves 18, 19. Of course, the water closet is also connected to the same water mains in order to enable flushing. If desired, these connections may also include flexible tubing FT, or they could be made via the valve system.

A height adjustment control shaft 22 (terminating in a control handle) is connected to the servo valves 18, 19, which are adjustable to any of three different positions. With the handle of lever 22 in its upper position, shaft 22 rotates and the valves 18, 19 place the hydraulic cylinder 15 under the pressure of the water mains. The resulting actuation of the piston 16 upon the trolley 4 elevates the water closet 8, upwardly. In its lower handle position, shaft 22 rotates and operates the valves to drain water from the hydraulic cylinder 15 and the water closet 8 is lowered. The shaft 22 always tends to return to the intermediate or neutral handle position, which is a central position. In this neutral position of the shaft 22, the water closet is maintained in any existing level, to which it had been previously moved responsive to a rotation of the shaft 22, as the handle moves into its upper or lower position.

The water closet, and the parts fastened to the covering plate 7, are located on the front side of the wall (not shown). The handle on shaft 22 is positioned at a location which is convenient to the user. Behind this wall is the framework 1, trolley 4, valves 18–21, hydraulic cylinder 15, hoses, tubes, and so on. Of course, the wall has to be constructed with any suitable openings or recesses which may be required so that the vertical displacement of the water closet is not blocked. These recesses are hidden behind the covering plate 7.

The above-described device relates to a wall-type water closet. Of course, the invention can be modified so that it may also be utilized with a floor-mounted water closet. In this case, it is preferably arranged so that the hydraulic cylinder actuates the water closet directly from below. By giving the cylinder diameter a sufficient size, the water closet has enough stability for guiding its movement to its different height positions.

Figure 2:
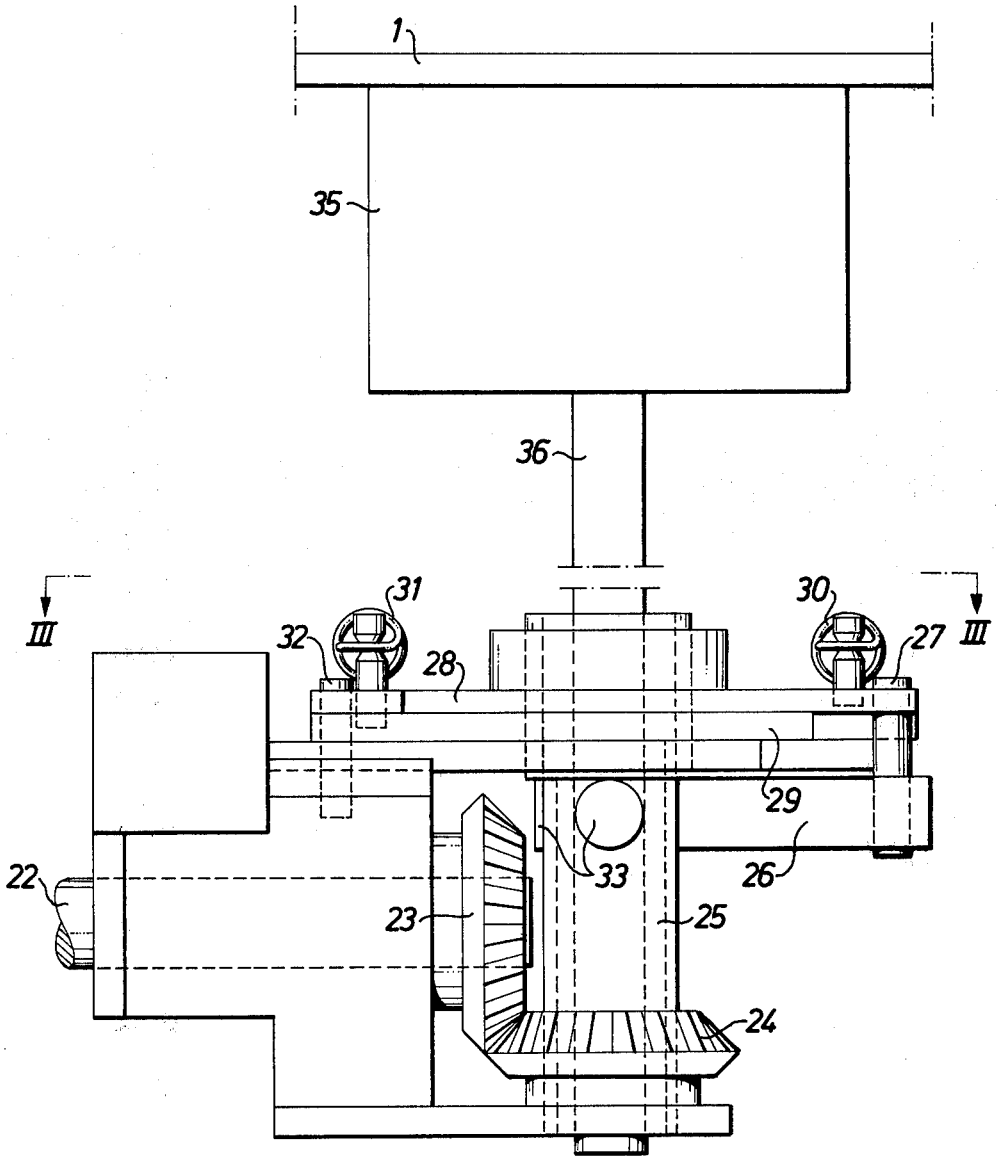
FIG. 2 is a side elevational view of a modified mechanism for controlling a valve included in the device, according to the invention.
Figure 3:
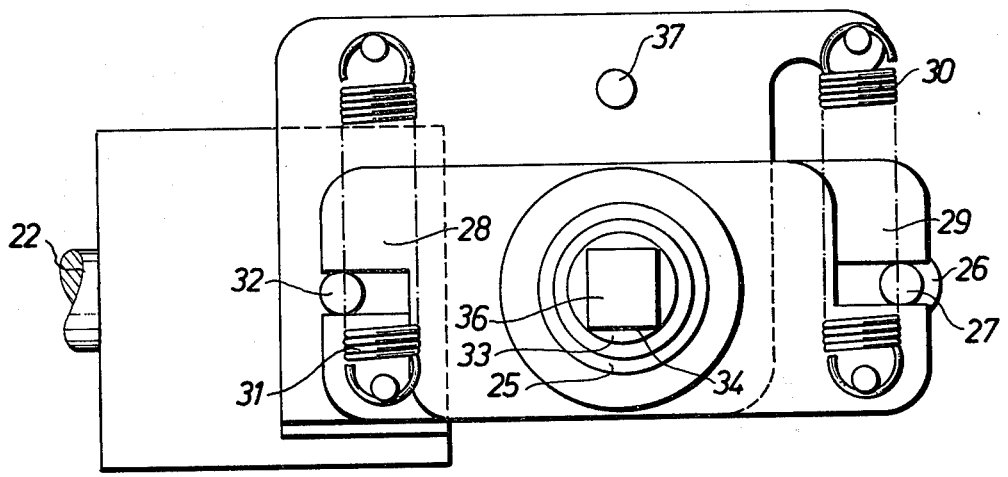
FIG. 3 is a top plan view of the control mechanism shown in FIG. 2, taken along line III—III of FIG. 2.

FIGS. 2 and 3 show an embodiment of the valve control mechanism. At the inner end of the horizontally extended shaft 22 and behind the covering plate 7 (not seen in FIGS. 2, 3) is a conical or bevel gear wheel 23, engaging and meshing with a horizontally located beveled gear wheel 24 which is, in turn, fastened to a vertical sleeve 25. To this sleeve 25 is fastened a horizontal lever 26 having an upstanding pin 27 on the end thereof. This pin 27 engages two horizontal plates 28 and 29 which are located one above the other. These horizontal plates are normally pressed against a stationary stop member 32 responsive to the bias of springs 30 and 31. These springs bias the plates 28 and 29, and through the actuation of the pin 27, keep the arm 26 and thus the gears 23, 24 and shaft 22 in the neutral central position. The entire device (just described) is moved together with the water closet when it is displaced vertically.

Opposite the arm 26, the sleeve 25 has four blocks 33 (FIG. 3), which form a square opening 34 inside the sleeve 25, which otherwise has a circular shape. Shaft 36 slidingly passes through, but is rotational within, the square opening 34 of the sleeve 25. This shaft 36 is stationary in the vertical (as seen in FIG. 2) direction, but is rotatable for actuating the value 35.

In FIG. 2, a valve 35 (for instance of a 4-way type valve) is fastened to the framework 1 and is connected to the water mains. A square shaft 36 controls this valve and, thus, the filling or emptying of hydraulic cylinder 15.

To decrease the friction between the plates 28, 29 and the shaft 36 during the rotation of these plates and their simultaneous displacement along the shaft 36, there is a common 45° right- and a 45° left-stop for the plates.

When the lever 22 is automatically moved to its neutral position, responsive to the bias of the springs 30 and 31, the shaft 36 is maintained in such a position and the hydraulic cylinder 15 is unaffected. The water closet is maintained in any position to which it has been previously adjusted.

When the handle of the shaft 22 rotates away from the neutral position, in either direction, away from the neutral position, the sleeve 25 is rotated through the bevel gears 23, 24. The sleeve 25 rotates the shaft 36 in either direction to actuate the hydraulic cylinder for lifting or lowering the water closet. When the handle is released, shaft 22 and this shaft 36 return to normal under the tensioning of either of the springs 30 or 31, depending upon the direction of the previous rotation.

The above-described devices can be applied to almost any sanitary or plumbing units other than water closets, such as bidets, washbasins, showers, and the like, in order to adjust their height position according to personal needs or wants. Of course, it is also possible to modify the device so that it can be used for horizontal displacement, such as, for instance, a shower.

It is also possible to modify the device so that it can be used with sanitary units, both those which are already installed and those which are new installations.

Those who are skilled in the art will readily perceive how to modify the system. Therefore, the appended claims are to be construed to cover all equivalent structures which fall within the true scope and spirit of the invention.

I claim:

1. A device for adjusting the vertical position of a water closet comprising water closet support means for movably displacing said water closet to any selected elevation between two limits, said support means including frame means for supporting the combined weight of both said water closet and a user thereof, a pair of vertically positioned U-shaped guide-rails attached to said frame and having the open sides of said U-shape facing each other, said guide rails extending parallel to a path followed by said water closet as it moves to a selected elevation between said two limits, an elongated substantially flat bed trolley means having four wheels mounted near corners on opposite sides and near the ends of the elongated sides of said trolley, said wheels being mounted to rotate about an axle in approximately the center plane of said trolley, a pair of said wheels being mounted to move inside the U-shape of each said guide rail, means on said trolley for connecting said water closet thereto, water pressure responsive means including an elongated hydraulic piston-cylinder actuated solely by water pressure, one end of said piston-cylinder being positioned on one side of and connected to said trolley by a substantially horizontal arm member extending from said trolley in a direction away from said water closet, said piston-cylinder being positioned on said frame for urging said trolley means to move toward said selected location under the force of said water pressure, said water closet being mounted on the other side of said trolley means, the frame, trolley, and water pressure responsive means all being well behind said water closet so that an assistant may freely reach a person using the water closet, and means positioned on said water closet under and near the hands of a user who is seated on said water closet for selectively controlling an application or removal of water to said piston-cylinder.

2. The device of claim 1 wherein said water pressure control means further comprises means extending from said position near the hands of the user to valve means connected to control a supply of said water.

3. The device of claim 1 and flexible means for connecting water supply and drain lines to said water closet.

* * * * *